US005907964A

United States Patent [19]

Girard et al.

[11] Patent Number: 5,907,964

[45] Date of Patent: Jun. 1, 1999

[54] LOCK FOR MOTOR VEHICLE DOOR AND METHOD FOR INSTALLATION OF SAME

[75] Inventors: Joel Girard, Abbeville; Janik Delaure, Agenvillers, both of France; Jonas Adolfsson, Kullavik, Sweden

[73] Assignees: Valeo Systemes de Fermetures, Sailly Flibeaucourt, France; AB Volvo Personvagnar, Goteborg, Sweden

[21] Appl. No.: 08/907,360

[22] Filed: Aug. 7, 1997

[30] Foreign Application Priority Data

Aug. 7, 1996 [FR] France ..... 96 09946

[51] Int. Cl.[6] ..... E05B 15/00

[52] U.S. Cl. ..... 70/418; 70/422; 70/372; 292/207

[58] Field of Search ..... 70/416, 417, 418, 70/422, 431, 372, 379 R, 380, 379 A; 411/349, 553, 552; 292/204, 206, 207

[56] References Cited

U.S. PATENT DOCUMENTS

| | | | |
|---|---|---|---|
| 1,386,671 | 8/1921 | Zych | 292/207 |
| 1,562,951 | 11/1925 | Franz, Jr. | 411/409 |
| 2,798,404 | 7/1957 | Schaefer et al. | 411/409 |
| 4,013,311 | 3/1977 | Prezioso | 70/417 |
| 4,226,454 | 10/1980 | Tranberg et al. | 70/380 |
| 4,334,704 | 6/1982 | Yamada . | |
| 4,712,817 | 12/1987 | Grandjean . | |
| 5,308,129 | 5/1994 | Hlavaty . | |
| 5,327,632 | 7/1994 | Moore | 70/416 |
| 5,676,002 | 10/1997 | Hoeptner, III | 70/416 |

FOREIGN PATENT DOCUMENTS

| | | | |
|---|---|---|---|
| 0 499 532 | 8/1992 | European Pat. Off. . | |
| 1098663 | 3/1955 | France | 292/207 |
| 2 199 363 | 5/1974 | France . | |
| 2636686 | 3/1990 | France | 411/552 |
| 2 695 674 | 3/1994 | France . | |
| 1136662 | 12/1968 | United Kingdom | 411/553 |
| 1256295 | 12/1971 | United Kingdom | 411/553 |
| 2136046 | 9/1984 | United Kingdom | 70/416 |

*Primary Examiner*—Darnell M. Boucher
*Attorney, Agent, or Firm*—Morgan & Finnegan, L.L.P.

[57] ABSTRACT

A cylinder-type lock for a motor vehicle door, having a lock housing and a plug lever, intend for control by the plug and able to move along a wall of the housing. An orifice is provided in the wall of the housing and another orifice is provided in the plug lever; the two orifices face one another when the lever is in an appropriate position for mounting. A wedge interacts with the two orifices in order to immobilize the lever with respect to the housing.

13 Claims, 1 Drawing Sheet

LOCK FOR MOTOR VEHICLE DOOR AND METHOD FOR INSTALLATION OF SAME

BACKGROUND OF THE INVENTION

The invention relates to a lock for a motor vehicle door and more particularly to a cylinder-type lock with a plug.

A motor vehicle is usually equipped with a cylinder-type lock either on each of the two front doors or on one of the front doors only. In the latter case, depending on whether the vehicle is a right-hand drive vehicle or a left-hand drive vehicle, the door which has to be equipped with the cylinder-type lock is respectively the right-hand door or the left-hand door. In any case, there are therefore two separate references for cylinder-type locks, namely one for the right-hand lock and one for the left-hind lock.

When a vehicle is equipped with a cylinder-type lock on just one door, for example the right-hand door, the other door, in this case the left-hand door, is fitted with a lock which does not have a plug. Now, this lock without a plug cannot be the same as the corresponding cylinder-type lock with a plug, for reasons of safety. This is because the cylinder-type lock with a plug carries a lever intended for it to be controlled by the plug, which lever projects from the lock casing. In the absence of a plug, this lever is no longer connected to the plug and is therefore easily accessible to a hook slipped, for example, into the door via the window seal; this hook would make it possible to actuate the lever and therefore unlock and open from the outside. To avoid this risk, locks without plugs do not have plug levers. These locks, respectively right-hand ones and left-hand ones, correspond to two distinct references.

The upshot of this is that it is necessary, in total, to have four-lock references, namely two references for locks, a right-hand one and a left-hand one respectively, including a plug lever and two references for locks, a right-hand one and a left-hand one respectively which do not have a plug lever.

BRIEF SUMMARY OF THE INVENTION

One of the objects of the invention is to reduce the number of lock references by avoiding having to omit the plug lever on locks, respectively right-hand ones and left-hand one intended to be mounted without the plug, without in so doing making it possible for the locks to be unlocked using a hook acting on the plug lever.

Moreover, when in a cylinder-type lock the plug lever is not connected to the plug, this may result in unpleasant noises because the plug lever and the end fastener which it carries, are not held. Another object of the invention is to avoid these noises.

Finally, when a cylinder-type lock with a plug is mounted on a vehicle door, the plug driver has to be in a position mid-way along its travel and, in the lock, the plug lever has also to be in a mid-way position for normal operation of the lock to be possible. Now, the linking element (link rod, cable, direct action) between the plug driver and the plug lever of the lock necessarily has to have excess length so as to ensure a connection within the range of tolerances regarding the mounting of the lock in the door. If the plug lever of the lock is not in its mid-way position at the moment the connection is made, the connection may nevertheless be achieved because of the excess length of the linking element, but it will result in defective operation of the lock, the travel of the lever being insufficient for it to be able to fulfil its role either during locking or during unlocking.

Another object of the invention is to propose a lock in which the plug lever, at the moment of mounting, lies in its appropriate position for mounting.

The subject of the invention is a cylinder-type lock for a motor vehicle door, having a lock housing and a plug lever, intended for controlling the lock by means of the plug by virtue of a linking element, for example link rod or cable, and which can move along a wall of the housing, characterized in that it includes an orifice in the wall of the housing and an orifice in the plug lever, the two orifices facing one another when the plug lever is in an appropriate position for it to be attached to the linking element, associated with the plug, a wedge being capable of interacting with the two orifices in order to immobilize the plug lever with respect to the housing.

According to other features of the invention:

- the wedge can be used for any positioning of a moving part with respect to another fixed element;
- the wedge has an active part and an operating element which are joined by a hinge region;
- the active part of the wedge includes a peg which goes into the orifice of the housing then into the orifice of the lever, the said peg at its end having an immobilizing means precluding it from being withdrawn after the wedge has been rotated;
- the immobilizing means borne by the peg of the active part of the wedge consists of two lugs arranged radially on each side of the peg, the said lugs being capable of passing through the orifices in the wall of the housing and in the plug lever then, after rotation, of becoming immobilized behind the plug lever;
- the peg is carried by a carrier plate which remains outside the housing when the wedge is fitted in the two orifices with which it interacts;
- the carrier plate carries, on each side of the peg, lumps intended to press against the housing so as, by interacting with the immobilizing means carried by the peg, to hold the plug lever against the wall of the housing to avoid any clearance between the lever and the wall of the housing;
- the operating element is a tab, the mid-plane of which, when at rest, contains the hinge region; it may have a central depression to make it easier to grasp when the wedge is being fitted but, as a preference, it does not have an opening so as to avoid it being picked;
- the wedge is entirely made of plastic, the hinge region being thinner in order to form a film hinge and allow the operating element to be tilted with respect to the active part of the wedge.

BRIEF DESCRIPTION OF THE DRAWINGS

Other features will emerge from the description which follows, given with reference to the attached drawing. In this drawing.

DETAILED DESCRIPTION OF THE INVENTION

Figure 1:
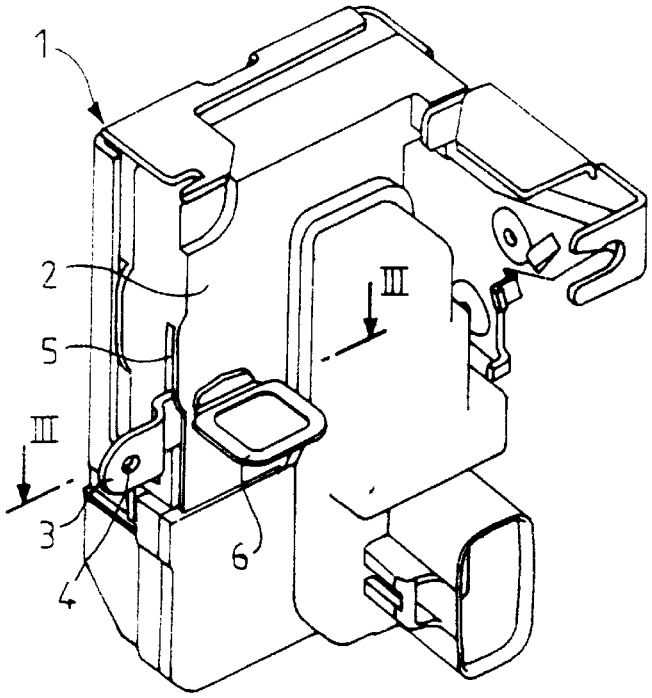
FIG. 1 is an overall perspective view of a lock for a vehicle door in accordance with the invention.

FIG. 1 represents the housing 1 of a cylinder-type lock for a motor vehicle door.

This housing 1 has a wall 2 along which a plug lever 3 of which only that part which projects out of the housing 1 is visible, can move. This plug lever 3 has a hole 4 for attaching the element providing a link between the plug driver and the plug lever 3.

In order to allow the plug lever 3 to move, the housing 1 includes a slot 5 which, in the embodiment represented, is vertical.

The plug lever 3 can move in a vertical plane by pivoting about an axis, not represented, parallel to the wall 2 of the housing 1, between a lowered position and a raised position, these positions lying respectively below and above its mid-way position represented. It is in this mid-way position that, according to the invention, the lever is immobilized with respect to the housing by means of a wedge 6.

Figure 3:
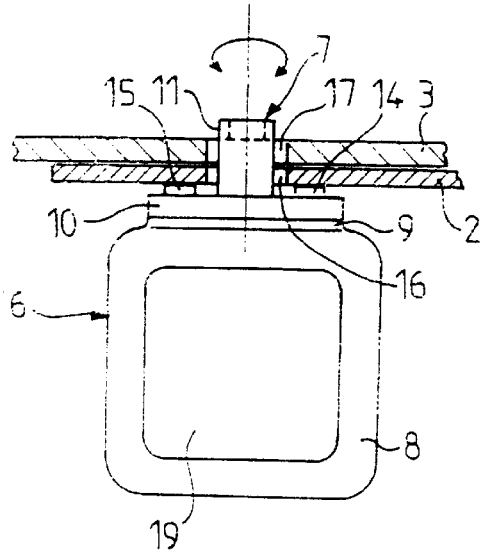
FIG. 3 is a view from above of the wedge for immobilizing the plug lever, with partial section on the line III—III of FIG. 1.
Figure 4:
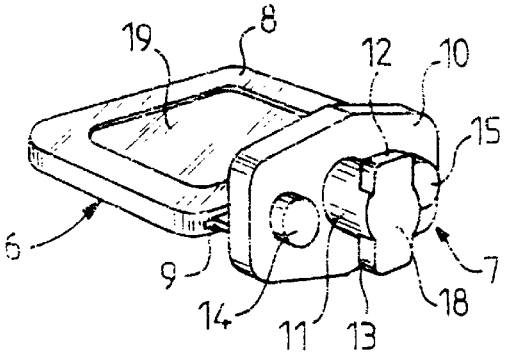
FIG. 4 is a perspective view of the wedge for immobilizing the plug lever, showing its active part.

FIGS. 3 and 4 make it possible to describe the wedge 6 and its various constituent elements. The wedge 6 includes an active part 7 and an operating element 8, connected by a hinge region 9.

The active part, in the embodiment described, consists of a carrier plate 10, a peg 11, two lugs 12 and 13 and two lumps 14, 15. The carrier plate 10 is a plate intended to be arranged parallel to the wall 2 of the lock housing. On one of its faces, the carrier plate 10 is secured to the hinge region 9. In the centre of its opposite face to the hinge region 9, the carrier plate 10 carries the peg 11 which is cylindrical and which at its free end carries the two lugs 12 and 13. These lugs 12, 13 are arranged radially and symmetrically to one another with respect to the peg 11. The carrier plate 10 also carries, on the same opposite face to the hinge region 9, that is to say on its face pointing towards the lock housing 1, the two lumps 14 and 15, which are arranged symmetrically to one another with respect to the peg 11. In the example represented, the two lumps 14 and 15 have the shape of cylindrical pins. The two lumps 14 and 15 have the same height with respect to the face of the carrier plate 10 which carries them.

The two lumps 14 and 15 are intended to press from the outside on the face 2 of the housing, while the two lugs 12 and 13 are intended to press from the inside on the plug lever 3, as represented in FIG. 3. The rear face of the lugs 12, 13 defines a first plane perpendicular to the peg 11. The front face of the lumps 14, 15 defines a second plane perpendicular to the peg 11 and parallel to the first plane. The distance between these two planes is designs to be equal to the sum of the thicknesses of the lever 3 and of the wall 2 of the housing, so that the lever 3 is held without clearance against the wall 2 of the housing so as to avoid any unpleasant noise when the door has no plug.

To ensure that the wedge 6 is correctly inserted, the wall 2 of the housing 1 and the plug lever 3 each are fitted with an orifice, 16 and 17 respectively, visible in FIG. 3, the shape of which corresponds to the end face 18 of the peg 11 and of the lugs 12 and 13, visible in FIG. 4. The wedge 6 is oriented so that the lugs 12, 13 enter the orifices 16 and 17; then the wedge 6 is turned through a quarter of a turn about the peg 11 as axis of pivoting and comes into the position represented in FIGS. 3 and 4: the lugs 12, 13 are bearing against the internal face of the lever 3, and the lumps 14, 15 are bearing against the external face of the wall 2 of the housing. The lever 3 is thus held bearing against the wall 2 of the housing 1.

The hinge region 9, thinned to constitute a pliable film constituting a hinge, is arranged along the longitudinal axis of the carrier plate 10, and in such a way as to be horizontal when the wedge 6 is in position on the lock housing 1, as represented in FIG. 1.

On the other side of the hinge region 9 there is the operating element 8, consisting of a tab, of which the mid-plane, when at rest, contains the hinge region 9 as represented in FIGS. 1, 3 and 4. The operating element 8 has a certain thickness around its periphery, visible in FIG. 4, and a lesser thickness in its central part 19 so as to constitute a depression with a view to making it easier to grasp when the wedge 6 is being fitted. The central part 19 of the operating element does not have an opening so as to avoid it being picked by a hook inserted into the door, through the window seal for example. The entire wedge 6 is made of plastic.

According to the invention, the cylinder-type lock has two mating orifices 16, 17, respectively in the wall 2 of the housing and in the plug lever 3, these orifices being positioned to correspond to the mid-way position of the plug lever 3. The lock is equipped with the wedge 6 and comes with the wedge in position as represented in FIG. 1.

If the lock is to interact with a plug, the housing 1 is mounted on the door, the element providing the link between the plug driver and the plug lever 3 is fitted, with the assurance that the plug lever 3 is in its mid-way position, owing to the presence of the wedge 6, then the wedge 6 is removed to allow the lock to be controlled by the plug.

Figure 2:
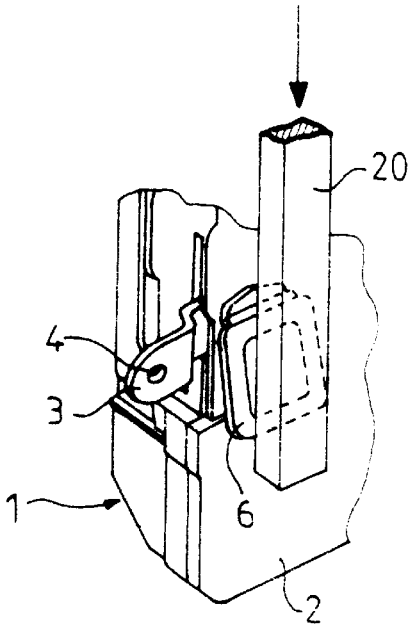
FIG. 2 is a view from the same viewpoint as FIG. 1, representing the wedge for immobilizing the plug lever after the drop glass guide rail has been mounted, for the case of a lock without a plug.

If, on the other hand, the lock is not to interact with a plug, then the housing 1 is mounted on the door and the wedge 6 is left in position. Then, the drop glass guide rail 20 is fitted vertically, in the direction of the arrow visible in FIG. 2. In the course of this fitting, the guide rail 20 presses against the operating element 8 of the wedge 6 and folds it down by pivoting at the hinge region 9. The operating element 8 thus finds itself folded down against the wall 2 of the housing 1 and held between the housing 1 and the guide rail 20, the active part 7 of the wedge 6 being inserted into the orifices 16, 17 and ensuring that the plug lever 3 is immobilized. This immobilization holds the lever 3 against the wall 2 of the housing, without clearance, avoiding unpleasant noises. This immobilization also prevents the plug lever 3 from being picked because, since it has a diameter of approximately 5 mm, the peg 11 can withstand a tensile force of approximately 500 Newtons.

With the provision of a wedge 6 according to the invention, it becomes necessary to provide just two references of lock, one for the right-hand door and the other for the left-hand door. It is no longer necessary to make a distinction between a cylinder-type lock with a plug and the lock without a plug. It is when the lock is being mounted that it becomes necessary to withdraw the wedge 6 for a cylinder-type lock with a plug, but only after the linking element has been mounted, to make it possible to benefit from the correct positioning of the plug lever 3, in its mid-way position, ensured by the wedge 6.

The wedge 6 with which locks according to the invention are equipped thus makes it possible to use just one type of lock for each vehicle door; it has a noise-suppression function because, in locks without plugs, it keeps the lever 3 against the wall 2 of the lock housing 1, avoiding movement or vibration thereof; it has a pick-proofing function because, in locks without a plug, it can withstand substantial tensile force on a lever which is being "picked"; it has a function of correctly positioning the plug lever 3 in cylinder locks with a plug during the operating of mounting the element forming the connection between the plug driver and the plug lever 3.

The wedge 6 of the lock according to the invention has been described and represented in one specific embodiment, the nature of which is not in any way limiting.

We claim:

1. A cylinder-type lock for a motor vehicle door, having a lock housing, a plug lever and a wedge, the lock housing having a vertical slot, the plug lever adapted to move along a wall of the housing in a vertical plane constrained by the vertical slot, the plug lever having a line of travel between a maximum raised position and a maximum lowered position, the housing having an orifice and the plug lever having an orifice, the two orifices facing one another when the plug lever is at a mid-way position along its line of travel as constrained by the vertical slot, the wedge adapted to interact with the two orifices in order to immobilize the plug lever with respect to the housing.

2. A lock according to claim 1, wherein the plug lever is immobilized by the wedge against the wall of the housing at a mid-way position along the line of travel of the wedge as constrained by the vertical slot.

3. A lock according to claim 1, wherein the wedge has an active part and an operating element which are joined by a hinge region.

4. A cylinder-type lock for a motor vehicle door, having a lock housing, a plug lever and a wedge, the plug lever adapted to move along a wall of the housing, the housing having an orifice and the plug lever having an orifice, the two orifices facing one another when the plug lever is at a mid-way position along the wall of the housing, the wedge adapted to interact with the two orifices in order to immobilize the plug lever with respect to the housing, and the wedge having an active part and an operating element which are joined by a hinge region, the active part including a peg having an end inserted first into the orifice of the housing and then into the orifice of the plug lever, the peg having at its end an immobilizing means precluding the peg from being withdrawn after the wedge has been rotated.

5. A lock according to claim 4, wherein the immobilizing means borne by the peg consists of two lugs arranged radially on each side of the peg, the lugs adapted to pass through the orifice in the housing and the orifice in the plug lever upon insertion of the peg into the two orifices, and then, after rotation of the wedge, adapted to be misaligned with respect to the two orifices, and immobilized behind the plug lever.

6. A lock according to claim 4, wherein the peg is carried by a carrier plate which remains outside the housing when the wedge is fitted in the two orifices with which it interacts.

7. A lock according to claim 6, wherein the carrier plate carries, on each side of the peg, lumps adapted to press against the housing so as, by acting in concert with the immobilizing means borne by the peg, to hold the plug lever against the wall of the housing.

8. A lock according to claim 3, wherein the operating element is a tab, the mid-plane of which, when at rest, contains the hinge region.

9. A cylinder-type lock for a motor vehicle door, having a lock housing, a plug lever and a wedge, the plug lever adapted to move along a wall of the housing, the housing having an orifice and the plug lever having an orifice, the two orifices facing one another when the plug lever is at a mid-way position along the wall of the housing, the wedge adapted to interact with the two orifices in order to immobilize the plug lever with respect to the housing, and the wedge having an active part and an operating element which are joined by a hinge region, the operating element being a tab, the mid-plane of which, when at rest, contains the hinge region, the tab having a central depression for ease in grasping when the wedge is being fitted.

10. A lock according to claim 3, wherein the wedge is entirely made of plastic, the hinge region being thinner than the active part and the operating element in order to allow the operating element to be tilted with respect to the active part of the wedge.

11. A lock according to claim 4 wherein the plug lever has a diameter of approximately 5 mm and the peg can withstand a tensile force of approximately 500 Newtons.

12. A method for installing a cylinder-type lock wherein the lock is to interact with a plug on a motor vehicle door comprising the steps of:

mounting the lock of claim 2 on the door via the housing;

positioning the plug lever at a point mid-way along its line of travel via use of the wedge;

positioning the plug driver at a point mid-way along its line of travel;

attaching the linking element between the plug lever and the plug driver; and removing the wedge.

13. A method for installing a cylinder-type lock wherein the lock is not to interact with a plug on a motor vehicle door comprising the steps of:

mounting the lock of claim 3 on the door via the housing;

inserting the active part of the wedge into the orifices of the housing and the plug lever; and vertically fitting the drop glass guide rail such that the guide rail presses against the operating element of the wedge and folds the wedge down by pivoting at the hinge region.

* * * * *

UNITED STATES PATENT AND TRADEMARK OFFICE

CERTIFICATE OF CORRECTION

PATENT NO. : 5,907,964

DATED : June 1, 1999

INVENTOR(S) : Joel Girard et al.

It is certified that errors appear in the above-identified patent and that said Letters Patent is hereby corrected as shown below:

Please delete the current abstract and, in lieu thereof, insert the following:

-- A cylinder-type lock for a motor vehicle door, having a lock housing, a plug lever, and a wedge. An orifice is provided in the wall of the housing and another orifice is provided in the plug lever; the two orifices face one another when the lever is in an appropriate position for mounting. A wedge interacts with the two orifices in order to immobilize the lever with respect to the housing. A method of installing the cylinder-type lock is also provided. --

Signed and Sealed this

Twelfth Day of September, 2000

*Attest:*

*Attesting Officer*

Q. TODD DICKINSON

*Director of Patents and Trademarks*